US005865948A

United States Patent [19]

Lora et al.

[11] Patent Number: 5,865,948

[45] Date of Patent: Feb. 2, 1999

[54] METHOD FOR STEAMING COMMINUTED CELLULOSIC FIBROUS MATERIAL DURING CONTINUOUS SOLVENT PULPING

[75] Inventors: Jairo H. Lora, Media, Pa.; John Patrick Maley, Vero Beach, Fla.; Brian F. Greenwood, Glens Falls, N.Y.; Joseph R. Phillips, Glens Falls, N.Y.; David J. Lebel, Glens Falls, N.Y.

[73] Assignee: Alcell Technologies Inc., Canada

[21] Appl. No.: 473,194

[22] Filed: Jun. 7, 1995

Related U.S. Application Data

[62] Division of Ser. No. 347,038, Nov. 30, 1994, which is a continuation of Ser. No. 569,126, Aug. 17, 1990, abandoned.

[51] Int. Cl.[6] ..... D21C 1/02; D21C 3/20; D21C 3/24

[52] U.S. Cl. ..... 162/19; 162/52; 162/68; 162/77

[58] Field of Search ..... 162/52, 246, 57, 162/263, 68, 77, 19, 17, 237, 236, 18

[56] References Cited

U.S. PATENT DOCUMENTS

| | | | |
|---|---|---|---|
| 4,096,027 | 6/1978 | Sherman | 162/68 |
| 4,231,842 | 11/1980 | Ojala | 162/47 |
| 4,401,510 | 8/1983 | Olson et al. | 162/19 |
| 4,496,426 | 1/1985 | Baumeister | 162/19 |
| 4,592,804 | 6/1986 | Noreus et al. | 162/68 |
| 5,053,108 | 10/1991 | Richter | 162/237 |

*Primary Examiner*—Steven Alvo
*Attorney, Agent, or Firm*—Reed Smith Shaw & McClay LLP

[57] ABSTRACT

A continuous solvent pulping process is practiced with oxygen free gas (e.g. nitrogen) purges of all major treatment vessels during the time when the process is arrested or terminated. The wood chips or other cellulosic fibrous material to be pulped is steamed in a first horizontal steaming zone at pressure of about 10–20 psi, and then in a second horizontal steaming zone at a pressure of about 20–75 psi. The first and second zones are isolated by a low pressure feeder. Steam is introduced into the material in the second steaming zone to flow cocurrently with it. Gases, including vaporized solvent (e.g. ethanol or other alcohol) are vented from the steaming zones, and solvent is added to the steamed material prior to feeding to a high pressure feeder. The high pressure feeder introduces the material into the top of a single digesting vessel, liquid and chips being separated at the top of the digester vessel without mechanical means that could cause a spark. Lignin containing liquid is withdrawn from a central portion of the digester and passed through flash tanks and ultimately for lignin and alcohol recovery. A recirculating screen and system is disposed between the central extraction portion and the top of the digester vessel. A portion of the liquid removed for recirculation is instead passed to lignin recovery, while fresh solvent containing liquid is added to the rest of the recirculated liquid.

8 Claims, 6 Drawing Sheets

METHOD FOR STEAMING COMMINUTED CELLULOSIC FIBROUS MATERIAL DURING CONTINUOUS SOLVENT PULPING

CROSS-REFERENCE TO RELATED APPLICATION

This is a divisional of application Ser. No. 08/347,038 filed on Nov. 30, 1994, which is a continuation application of U.S. application Ser. No. 07/569,126 filed Aug. 17, 1990 entitled "CONTINUOUS SOLVENT PULPING AND WASHING PROCESSES AND APPARATUS", now abandoned.

BACKGROUND AND SUMMARY OF THE INVENTION

One alternative to the production of paper pulp by conventional kraft and sulfite chemical pulping technologies in solvent pulping. Most proposed solvent pulping processes, such as disclosed in U.S. Pat. Nos. 4,764,596 and 4,100,016, use alcohol as a solvent, particularly an ethanol and methanol mixture. The alcohol is introduced with wood chips into a batch digester, and after cooking the material is subjected to three different washes in the batch digester, the first wash with a slightly weakened cooking liquor (containing alcohol), the second wash with a weak cooking liquor, and the third wash with water. One of the proposed advantages of the solvent pulping technique is that lignin may be recovered from the "black liquor" produced from the process (a solution of lignin in a water miscible organic solvent such as a lower aliphatic alcohol). It is necessary, in order to make the system economical to recover as much of the alcohol as possible. Significant markets may also develop for the lignin, which may make solvent pulping economical and advantageous.

At the present time, there are no known large scale commercial installations in which solvent pulping is practiced. One of the most significant reasons for this is the inability to recover a substantial enough portion of the alcohol. If one utilizes a batch digester, with washing in the digester, as/described above, the alcohol consumption may be such as to make the procedure economically unattractive.

There are certain problems associated with proposed solvent pulping systems. One is the potential safety hazard as a result of solvent vapor, oxygen (i.e. an oxidative gas), and a condition—such as a spark—capable of producing an explosion, combining. In order to guard against this, when the operation of the batch digester is being arrested or terminated, any portions thereof where vapor can collect are purged with nitrogen, or a like substantially oxygen free gas.

It has been recognized for many years that the solvent pulping process could theoretically be improved if it were made continuous, such as the majority of commercial kraft and sulfite pulping systems. However the safety problems described above, plus the need for equipment to maintain sufficient pressures to accommodate solvent pulping (which pressures are much higher than for kraft pulping) made the realization of that ideal difficult to achieve. It was also recognized that the lack of recovery of a substantial portion of the alcohol as a result of washing was a major drawback, but techniques for significantly reducing the alcohol loss were not envisioned.

According to the present invention, it is possible to make the solvent pulping process continuous. Also, according to the present invention, it is possible to wash pulp produced by solvent pulping (either by a continuous process or batch process) so that the alcohol loss per ton of pulp is at an economical level (e.g. about ten gallons or less; an economically acceptable level).

In the design of equipment to make the solvent pulping process continuous, to the extent possible conventional Kamyr® vessels and equipment from kraft and sulfite chemical pulping processes are utilized. However it is necessary to provide additional equipment, reconfigure the equipment, and substitute components capable of handling higher pressure, in order for the system to work effectively.

In the production of washing equipment which can effectively wash the lignin from the pulp, and also wash the alcohol therefrom so that a substantial portion of the alcohol is effectively recovered, again conventional Kamyr® and Ahlstrom equipment is utilized to the maximum extent possible. However the equipment must be configured in a novel system, and various changes made thereto.

According to one aspect of the present invention, apparatus is provided for steaming comminuted cellulosic fibrous material chips for feeding from a high pressure feeder to a continuous digester, and a method for steaming such chips during solvent pulping thereof. The apparatus comprises: A chips bin, having a chips outlet at the bottom thereof. A first horizontally extending steaming vessel having a chips inlet and outlet, a steam inlet, and a gas vent. A second horizontally extending steaming vessel having a chips inlet and outlet, and a gas vent. A first low pressure feeder between the chips bin outlet and the first steaming vessel chips inlet. A second low pressure feeder between the second steaming vessel chips inlet and the first steaming vessel chips outlet, including a first conduit extending from the second low pressure feeder to the second steaming vessel chips inlet. A second conduit extends from the second steaming vessel chips outlet and is connected to the high pressure feeder inlet. And, means for introducing steam into the second steaming vessel through the first conduit so as to flow with chips from the second low pressure feeder into the second steaming vessel chips inlet.

The gas vent from the second steaming vessel extends upwardly therefrom on the discharge end, and the second conduit extends downwardly from the second steaming vessel generally opposite the gas vent. For safety, means are provided for introducing a substantially oxygen free purging gas into the second conduit to flow upwardly into the second steaming vessel during shutdown of the apparatus. Solvent recovery means is operatively connected to the steaming vessel gas vents.

In the method of steaming cellulosic fibrous material during solvent pulping thereof according to the invention, first and second steam zones are utilized. The method comprises the steps of continuously: (a) Adding steam to material in the first steaming zone while maintaining the pressure at about 10–20 psi. (b) Isolating the first steaming zone from the second steaming zone. (c) Maintaining the pressure in the second steaming zone at about 20–75 psi. (d) Purging the second steaming zone with steam by introducing steam into the material to flow concurrently with the material into and through the second steaming zone. (e) Venting gases, including vaporized solvent, from the fist and second steaming zones. (f) Discharging steamed material from the second steaming zone to the high pressure feeder. And, (g), adding solvent to the discharged material from the second seaming zone prior to its introduction into the high pressure feeder. The material is moved generally horizontally within the first and second steaming zones, and step (g) is practiced by adding ethanol as the solvent, preferably with about 10% methanol added thereto. The second steaming zone is purged with nitrogen or other substantially oxygen free gas when the practice of steps (a)–(g) is arrested or terminated.

According to another aspect of the present invention, the digester vessel itself is configured so as to minimize the risk of explosion and to maximize extraction of lignin containing liquid. In the solvent pulping process the ratio of liquid to cellulosic fibrous material is much higher than in kraft pulping, typically on the order of about 6–9 to 1, as opposed to a 4–5 to 1 ratio for kraft pulping. These goals are accomplished according to the invention by utilizing a vessel free of mechanical liquid/material separating devices at the top thereof. Heretofore, all single vessel continuous digesting systems have utilized a mechanical separator at the top, typically a screw rotating in a perforate cylinder. According to the invention, however, separation is accomplished utilizing a plurality of screens, and controlling the operation of the screens so that liquid is periodically withdrawn from one, then withdrawal is terminated, and then started again, etc., at all times at least some of the screens operating, and at all times at least some of the screens being dormant. The excess extraction is handled by adding screens to the digester, and—in a recirculating loop between the central extraction portion for the lignin containing liquor, in the top of the digester—removing a portion of the withdrawn liquid from the recirculating loop, sending that removed portion (which contains a substantial amount of lignin) to lignin recovery, and making up for the removed portion with fresh solvent cooking liquor, which is heated with the recirculated liquid and reintroduced into the digester via the central pipe bundle, exiting in the center of the chip column at an elevation slightly above or below the respective extraction screen. The recirculating loop screen and system comprises a withdrawal conduit having an isolation valve and a flow control valve, and a replacement liquid conduit having an isolation valve and flow control valve.

The method of solvent pulping to accomplish the objectives set forth above is practiced by the steps of continuously: (a) Steaming the material to remove the air therefrom. (b) Mixing the material with solvent pulping liquid to produce a mixture. (c) Feeding the mixture of material and solvent pulping liquid under pressure to the top of the vessel. (d) Separating some liquid from the material at the top of the vessel in a manner positively precluding the generation of electrical or mechanical sparks. (e) Returning the separated liquid from step (d) to step (b). (f) Withdrawing a liquor having a high concentration of dissolved lignin from a central portion of the vessel. And, (g) withdrawing produced pulp from the bottom of the vessel. Step (d) is practiced by the steps consisting essentially of providing a plurality of screens at the top of the vessel, withdrawing liquid through at least one screen while liquid is not being withdrawn through at least one other screen, and periodically switching which screens liquid is and is not being withdrawn through. During arresting or terminating the practice of steps (a)–(c), oxygen free gas is passed through the material countercurrent to the normal direction of flow of the material to prevent explosive vapor from collecting. Countercurrent diffusion washing of lignin from the pulp begins in the lower portion of the digester vessel where filtrate from the external washing stages is introduced and flows upward through the vessel counter to the flow of chips. The rate of flow of washing medium counter to the chip flow in the digester will be in the range of 1–4 tons of alcohol/water mixture per ton of dried pulp leaving the digester.

Washing of the pulp produced by solvent pulping—either by a batch or continuous process—is accomplished in a number of stages, at high pressures. The first stage is preferably a pressure diffuser, which is capable of operating at up to about 600 psi, and typically will operate at a pressure of at least about 350 psi, typically about 425–450 psi. In the pressure diffuser, the lignin is washed out of the pulp utilizing as the wash liquid a mixture of solvent and water, typically at least about 50% ethanol-methanol, and the rest water. The pulp from the pressure diffuser passes to storage vessel, and then to a first multi stage drum displacer washer, and then to a second multi stage drum displacer washer. Fresh water washes alcohol from the pulp in the second multi stage drum displacer washer, with the spent wash liquid therefrom used as the wash liquid in the first multi stage drum displacer washer, and the spent liquid from the first multi stage drum displacer washer used—with make-up alcohol—in the pressure diffuser. In all of these vessels it is necessary to purge any portions thereof where vapor may collect during normal operation and when operation is arrested or terminated, the purging taking place using nitrogen or a like substantially oxygen free gas.

The lignin rich spent wash liquid from the pressure diffuser, which also contains a large amount of alcohol, passes through a fiber filter. A first stream—which has been filtered so that it is substantially free of fibers—then passes to lignin and alcohol recovery, while a second stream—which still has fibers therein—is returned to the pulping system, to be introduced into the steamed chips as part of the solvent mixture slurrying the chips for the high pressure feeder, or into the bottom of the digester vessel to be used as wash medium in the countercurrent diffusion washing zone. Utilizing such a washing system it is possible to recover substantially all of the alcohol, that is all except for about ten gallons or less per ton of pulp produced.

It is the primary object of the present invention to provide a continuous solvent pulping method and apparatus, and/or to provide for effective washing of pulp produced by solvent pulping, so as to maximize alcohol recovery. This and other objects of the invention will become clear from an inspection of the detailed description of the invention, and from the appended claims.

BRIEF DESCRIPTION OF THE DRAWINGS

FIG. 1 (i.e. FIG. 2 (i.e.

DETAILED DESCRIPTION OF THE DRAWINGS

Figure 1A:
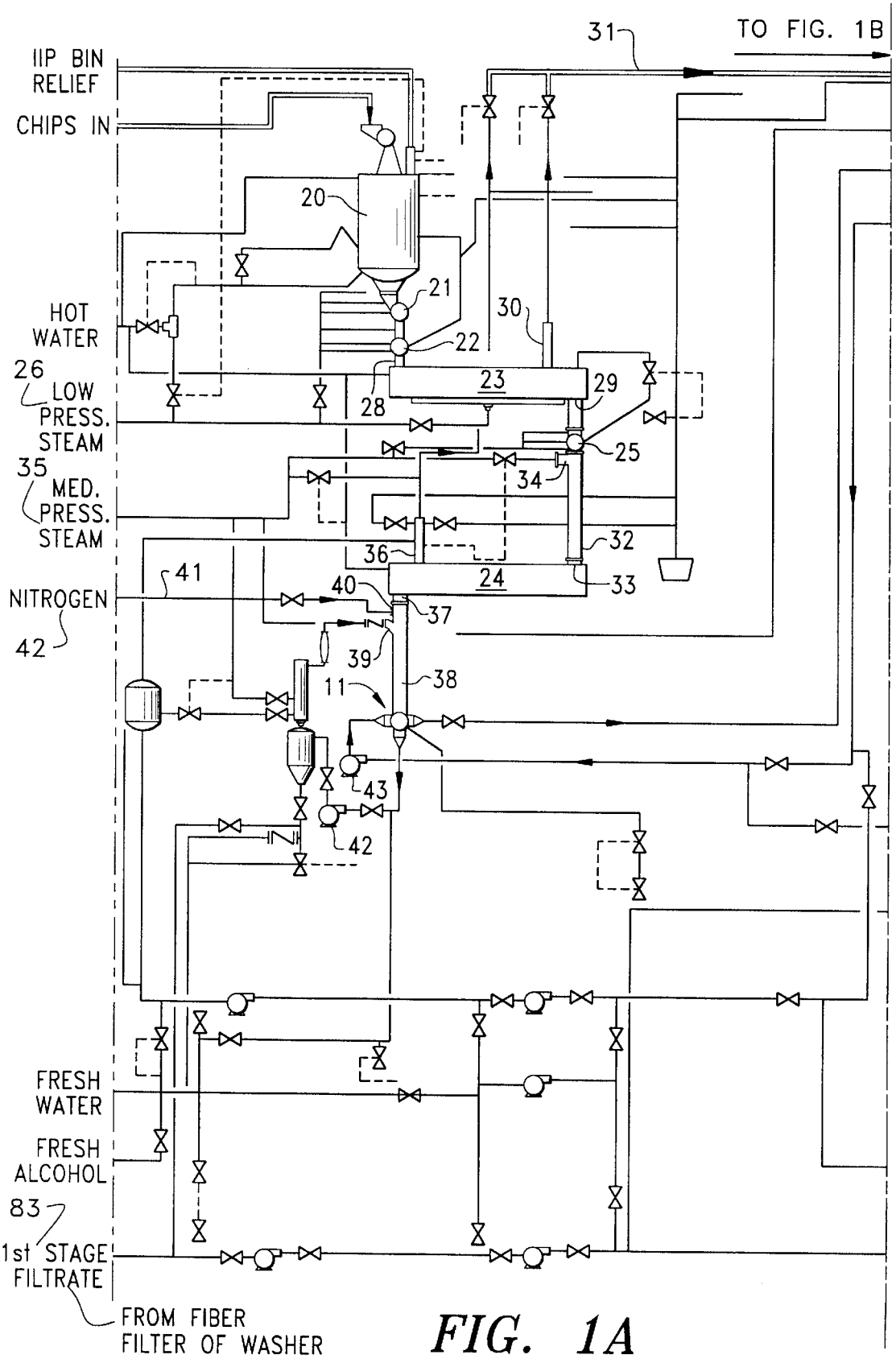
FIGS. 1A–1C) is a schematic view of an exemplary apparatus for practicing continuous solvent pulping according to the invention.
Figure 1B:
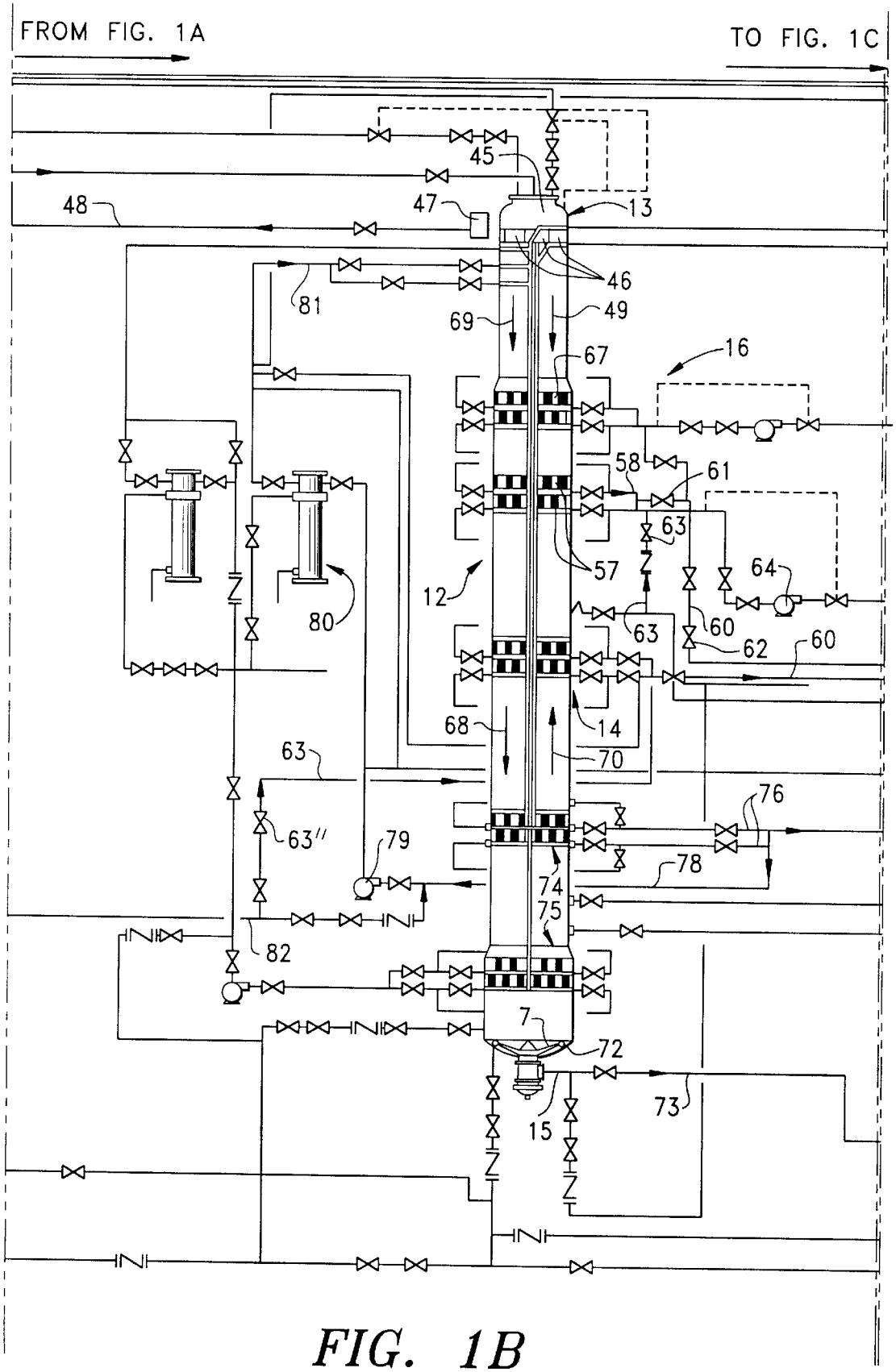
Figure 1C:
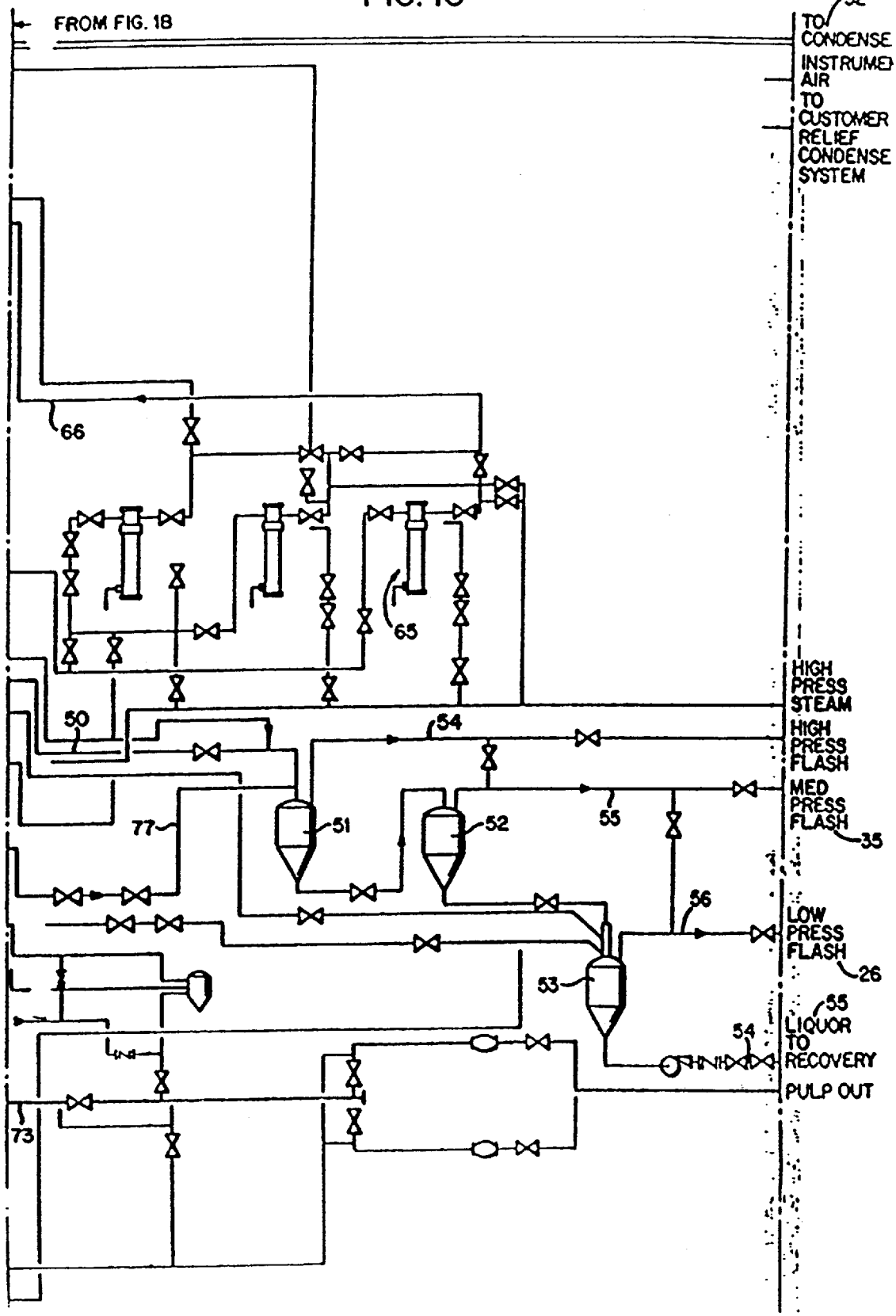

Exemplary apparatus for continuous solvent pulping of comminuted cellulosic fibrous material, such as wood chips, is illustrated schematically in FIGS. 1A–1C. The major components of the apparatus include a system for steaming the material to remove the air therefrom, illustrated generally by reference numeral 10, a high pressure feeder and associated components—illustrated generally by reference numeral 11—for feeding the slurried chips to the digesting vessel; and the upright continuous digesting vessel shown generally by reference numeral 12. The digester (extractor) 12 has associated therewith non-sparking liquid/material separation means 13 at the top thereof, a central extraction area and system 14 for the withdrawal of lignin containing liquid; and a pulp discharge 15 at the bottom thereof. Also a recirculation system 16 is provided between the central portion system 14 and the top separation system 13.

The steaming apparatus 10 (FIG. 1A) is not novel. In a conventional kraft system, a chips bin 20 is provided, connected via a chip meter 21 and low pressure feeder 22 to a horizontal steaming vessel 23. However the horizontal steaming vessel 23 is then typically connected directly to the high pressure feeder 11. Such an arrangement is not satisfactory for solvent pulping, however. According to the invention it is necessary to utilize a second horizontal steaming vessel 24 with a second low pressure feeder 25 isolating the two steaming vessels.

The vessel 23 is operated at a much lower pressure than the vessel 24. Typically the pressure in vessel 23 is about 10–20 psi. In the vessel 24 the pressure is typically about 20–75 psi, preferably about 45 psi.

Steaming may be done in the chips bin 20, as is conventional, and steaming is done in the first steaming vessel 23 by passing low pressure steam from source 26 to an introduction plenum 27 along a significant part of the middle portion of the vessel 23, as is conventional. Chips are introduced into the vessel 23 from the low pressure feeder 22 into chips inlet 28, and pass out of the vessel 23 through chips outlet 29. Gases—including solvent vapor—are vented through vertically extending vent pipe 30 which is connected to conduit 31 which ultimately passes to a condenser 32, for removal of the alcohol therefrom.

A first vertical conduit 32 is provided between the second low pressure feeder 25 and the chips inlet 33 to-the-second steaming vessel 24. Steam from medium pressure steam source 35 is introduced into the conduit 32 at introduction port 34 (just below feeder 25) to purge the chips, the steam and chips together entering the vessel 24 through the chips inlet 33. This minimizes the possibility that solvent vapor will pass backwardly through the system.

Gases are vented from the vessel 24 by gas vent 36, which is near the chips outlet 37, and extends upwardly from the vessel 24. Extending downwardly from the chips outlet 37—generally opposite the vent 36—is a second vertical conduit 38, which is connected to the high pressure feeder 11. Within the conduit 38 the chips are slurried with solvent cooking liquor, the solvent—e.g. a mixture of 90% ethanol and 10% methanol—is introduced at port 39.

When the steaming operation is arrested or terminated, one must be careful that no solvent vapors collect in pockets within any of the vessels. If such collection occurs, a very large safety hazard occurs, since if the vapor mixes with oxygen—if the temperature conditions are right, or if there is a spark—an explosion can occur. In order to preclude this possibility, according to the invention means are provided for introducing a purging gas into the conduit 38 at port 40 to flow countercurrent to the normal flow of chips through the vessel 24, etc. The purging gas is preferably provided through conduit 41 from a source of pure nitrogen 42 or the like. It is to be understood that any substantially oxygen free gas (meaning any gas not having oxygen or any oxidative—or solvent, such as alcohol—component) that is economical may be utilized. "Pure" nitrogen (that is a gas containing substantially all nitrogen, although certainly impurities will exist) is best suited from the cost standpoint.

The high pressure feeder 11 (FIG. 1A) according to the invention must be specially designed. It must be capable of withstanding pressures much greater than for conventional chemical pulping systems. While it is possible to beef up a conventional Kamyr® high pressure feeder so that it can handle 700 psi (rather than the 300 psi that is conventional), alternatively a Kamyr® shoe feeder can be utilized, such as disclosed in U.S. Pat. Nos. 4,516,887 and/or 4,430,029. The rest of the components associated with the high pressure feeder 11, such as a low pressure pump 42, high pressure pump 43, sand separator, level tank, etc. (all unnumbered) are conventional, except that they must be capable of withstanding the larger pressures typically encountered in a solvent pulp process.

From the high pressure feeder 11 the steamed chips entrained in solvent and water are passed in line 44 to the top 45 of the digester 12 (FIG. 1B). As previously indicated, the top 45 of the digester 12 includes a solids/liquid separator separating apparatus 13, however the apparatus 13 is not conventional in one vessel hydraulic digesting systems. Instead of a screw and perforated cylinder, or the like, as is conventional, the solids/liquid separator 13 comprises a plurality of screens 46, and a switching means 47 for controlling which of the screens 46 has extraction therethrough, and which screens are dormant (i.e. have no extraction therethrough). Typical screen switching systems are shown in U.S. Pat. No. 4,547,264, and the references cited therein. The liquid that is withdrawn passes into conduit 48, and then is returned to the high pressure feeder 11.

It would not typically be expected that a non-mechanical, spark free liquid/material separation system such as the system 13 could be utilized to effectively accomplish its separating function. However it is possible, according to the intention, because the alcohol cooking liquor has a specific gravity much less than the typical kraft cooking liquor. The alcohol-water mixture which carries the chips in the line 44 typically has a specific gravity of about 0.6–0.8 (depending upon temperature and being very sensitive to the temperature). The same liquid in a kraft system has a specific gravity of about 1.0–1.05. This means that the buoyancy of the chips in the liquid is much less, and therefore the chips will have a tendency to move downwardly in the vessel 12 more quickly. The downward movement of the chips is illustrated by arrow 49 in FIG. 1B.

As previously mentioned, extraction of lignin rich liquid from the digester 12 occurs at the central portion system 14 thereof. The lignin rich liquid is extracted through the screens of the system 14 into line 50, and then passes to a series of flash tanks, e.g. first, second, and third flash tanks 51–53 (FIG. 1C). In each case, a mixture of water and solvent vapor, generally enriched in solvent concentration flashes off of the liquid, and the liquid is concentrated, the concentrated liquid ultimately passing in line 54 to liquor recovery stage 55 where the lignin and alcohol are recovered in a known manner (e.g. see U.S. Pat. No. 4,764,596 for one example). The vapor mixture which flashes off from the tanks 51–53 passes into lines 54 through 56, and depending upon its pressure is ultimately used elsewhere within the system, e.g. as process heat in the solvent recovery system.

Between the top of the vessel 45 and the central extraction portion 14 a recirculation screen and system means is provided, shown generally by the reference numeral 16. This system includes, for example, screens 57 from which liquid is withdrawn in conduits 58 and 59. At the level of the screens 57, some of the lignin has already dissolved, therefore the liquid in the conduits 58, 59 has lignin therein. In order to maintain the liquid/material ratio at the desired high proportion of liquid, according to the invention a portion of the liquid from the conduits 58, 59 is removed in conduit 60.

Conduit 60 includes an isolation valve 61 and a flow control valve 62 therein. The lignin rich liquid in conduit 60 is introduced into the conduit 50 just before first flash tank 51. The rest of the liquid removed in the conduits 58, 59—as well as a source of fresh solvent in conduit 63, to reduce the solids ratio of the liquid—is passed by pump 64 to conventional indirect heater 65, and is ultimately recirculated in line 66 to a portion of the interior of the digester 12 above the screens 57. The line 63 also includes an isolation valve 63' and a flow control valve 63".

In the exemplary embodiment illustrated in FIG. 1B, a second set of screens 67, with corresponding conduits, heater, and recirculation path (unnumbered—see FIG. 1C) is also utilized, and an additional heater is provided in case one of the two normally used heaters malfunctions.

The chips continue to flow downwardly in the vessel 12 past the central portion 14, as illustrated by arrow 68, however while the solvent flows downwardly in the top portion of the vessel—as illustrated by arrow 69—below the extraction portion 14 the liquid flows countercurrent to the chips, as illustrated by arrow 70. A conventional scraper 71 is provided at the bottom 72 of the vessel, with the pulp extracted in pulp outlet 15 connected to blow line 73. According to the invention, again—in order to handle the relatively large volume of liquid compared to kraft or sulfite processes—the extra sets of screens 74, 75 are utilized. A portion of the liquid withdrawn in conduits 76 from the screens 74 passes in line 77 to be flashed in the flash tank 51, while the rest is recirculated in conduit 78, under the influence of pump 79, being passed to heater 80 and then ultimately returned via conduit 81 to the top of the digester 12. The purpose of splitting the flows into conduits 77, 78 is to remove some of the solids and replace them with liquid, the fresh liquid containing solvent being added in conduit 82. Conduit 82—which supplies fresh liquid both to the conduit 78 and the conduit 63—is ultimately connected up to the filtrate stage 83 from the washing system, to be hereinafter described with respect to FIGS. 2A–2C.

In the entire solvent pulping process of FIGS. 1A–1C, it is necessary to maintain the pressure above the vapor pressure of the alcohol-water mixture at all points. With one particular useful mixture of alcohol and water, the pressure would be maintained at about 425–450 psi. However it is conceivable that the pressure could be as high as 600 psi, therefore the vessel 12 should be constructed to accommodate such a pressure.

Within the digester 12 the temperature is approximately the same as for the batch solvent pulping process. That is typically in the vessel 12 between the screens 74 and 57 the temperature will be about 360°–400° F. Both above and below those points the temperature will be less; for example the temperature in pulp discharge 15 is about 190°F.

Figure 2A:
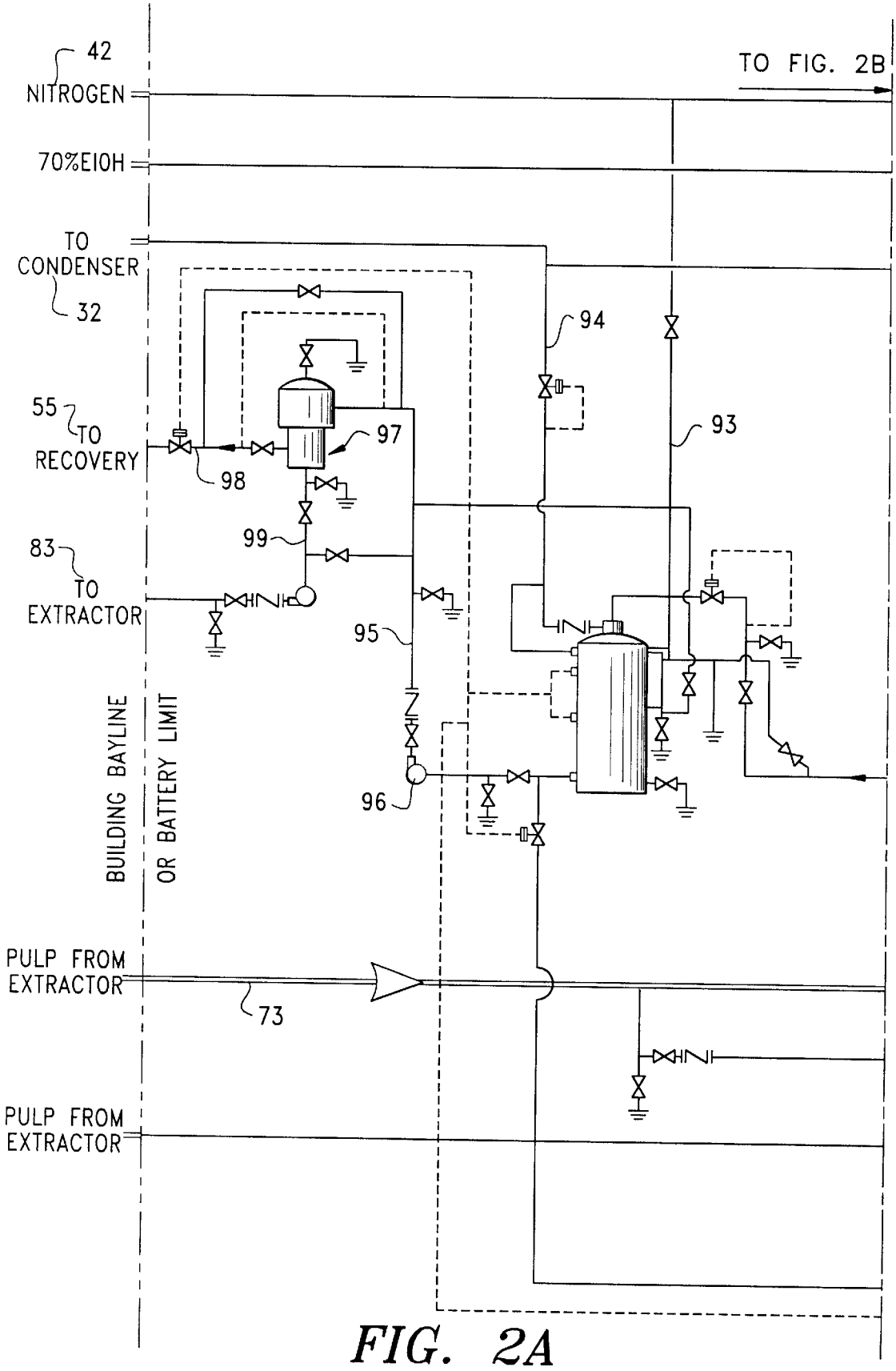
FIGS. 2A–2C) is a schematic view of exemplary apparatus for practicing washing of pulp produced by a batch or continuous solvent pulping process, the system of FIG. 2 utilizable with that of FIG. 1, but also being separately utilizable.
Figure 2B:
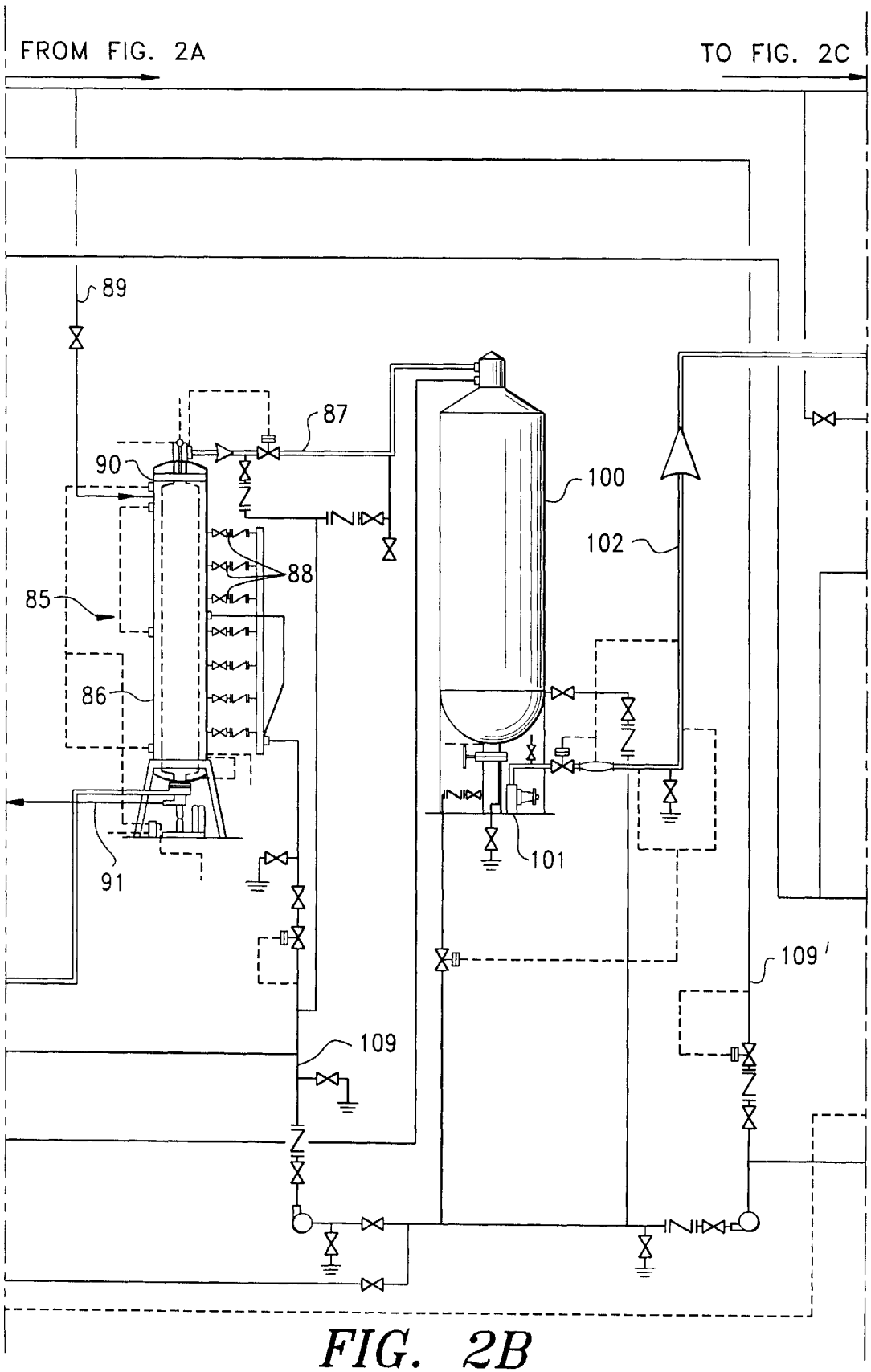
Figure 2C:
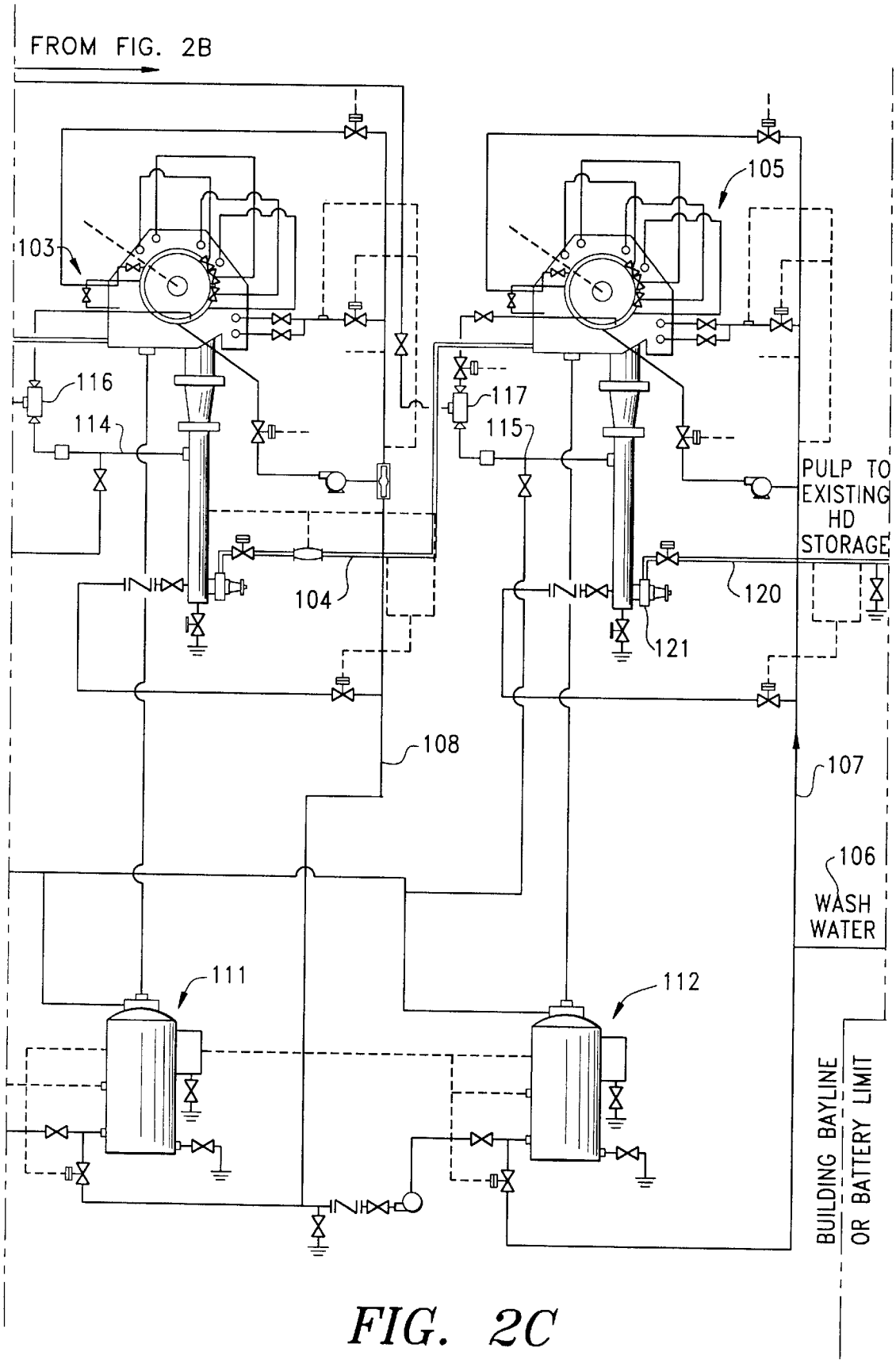

FIGS. 2A–2C illustrate the desired washing apparatus according to the invention, which preferably is utilized with the continuous solvent pulping system of FIGS. 1A–1C, but may also be utilized with the discharge from a batch digester.

Assuming that the apparatus of FIGS. 2A–2C is utilized with the pulping system of FIGS. 1A–1C, pulp from line 73 passes to the washing stage 85, entering the bottom of the vessel 86 (FIG. 2B) and moving upwardly therein to the discharge line 87. In the first stage 85, the lignin is removed from the pulp. Preferably this is accomplished by utilizing as the vessel 86 a conventional Kamyr® pressure diffuser. The pressure diffuser 86 must be capable of operation at 600 psi, again at pressures higher than the vapor pressure of the alcohol-water mixture, and is typically at least about 350 psi (preferably at least about 425 psi). Headers 88 are provided for the introduction of wash water into vessel 86.

The vessel 86 is different than the conventional Kamyr® pressure diffuser, however, in that a nitrogen purge system is also provided. From the nitrogen source 42 a line 89 extends to a top portion 90 of the vessel 86. Nitrogen gas is introduced into the vessel 86 if the washing operation is ever arrested or terminated, and serves to purge the vessel 86 so that no vapors will collect therein, which vapors could contain alcohol and thereby present an explosion hazard.

Lignin is recovered from the spent wash liquor in line 91 extending from the bottom of the vessel 86. The spent wash liquor in line 91 passes to filtrate tank 92. A nitrogen purge line and system 93 also is provided for the filtrate tank 92. Some of the liquid introduced into line 92 passes in line 94 to a condenser 32, however the majority of the fluid, in liquid form, passes in line 95 under the influence of pump 96 to a fiber filter 97. The fiber filter 97 divides the liquid flow into a first steam 98—which is substantially devoid of fiber—and into a second stream 99, which does contain fiber. The liquid in line 99 passes back to the pulping process of FIG. 1—that is to the first stage filtrate source 83 (FIG. 1A) thereof. The liquid in line 98 passes to recovery station 55, where the lignin and alcohol are recovered. Utilizing the system of FIGS. 2A–2C it is possible to recover all but about ten gallons of alcohol per ton of pulp produced.

After exiting the first washing stage 85 in line 87, the pulp preferably passes to a storage tank 100. The storage 100 provides for surge protection between what is upstream and downstream thereof. Pulp is withdrawn from the bottom of the tank 100 via pump 101 and passes in line 102 to a second washing stage 103, and then ultimately in line 104 to a third washing stage 105 (FIG. 2C). The stages 103, 105 preferably are provided by four stage Ahlstrom drum displacer washers, commercially available from Ahlstrom Machinery of Atlanta, Ga. These washers 103, 105 are connected in series. The pressure in drum displacer washers 103, 105 is significantly less than in washer 86.

The combined washing efficiency of the second and third stage units 103, 105 must be equivalent to 18–20 theoretical Nordan ($N_{12}$) stages.

Fresh wash water from source 106 is introduced in line 107 to the third stage washer 105, with the spent wash liquid withdrawn therefrom ultimately passing into line 108 to be used as wash liquid in second stage 103. The spent wash liquid from second stage 103—which contains a significant amount of alcohol—ultimately passes into line 109 to be provided to the wash headers 88.

Fresh solvent of concentration equal or higher than required by the extraction process (digester) is added to stream 109 via stream 109'. By this means, the concentration of counter flowing filtrate is maintained at the level required for the extraction process.

Each of the washers 103, 105—as well as the filtrate tanks 111, 112 associated therewith—is purged with nitrogen when the washing is arrested or terminated, as earlier described with respect to the first washing stage vessel 86. The point of introduction of the nitrogen purge for safety purposes is in line 114 for the vessel 103 and line 115 for the washer 105. Nitrogen is used for another purpose in the washers 103, 105, however. In conventional Ahlstrom drum displacer washers, pulp is typically expelled from pockets of the washer utilizing a blast of high pressure gas. Air is used as this gas in conventional drum washers, however air cannot be used—for safety reasons in the utilization of the apparatus of FIG. 2. Therefore, nitrogen from compressed nitrogen tanks 116, 117 is fed into the washers 103, 105 respectively, to expel pulp from the pockets therein.

The final pulp produced is expelled in line 120 from the last washer 105 by pump 121 and is passed to high density storage, to a bleaching plant, or otherwise utilized in known and conventional manners.

It will thus be seen that according to the present invention it is possible to make a solvent pulping process continuous. Also, according to the present invention it is possible to economically wash pulp from a solvent pulping process (batch or continuous) so that all but a small portion of the alcohol is recovered therefrom. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and procedures.

We claim:

1. A method for steaming cellulosic fibrous material during solvent pulping thereof, utilizing a first steaming zone, a second steaming zone in series with the first zone, and a high pressure feeder for feeding material mixed with solvent pulping liquor to a pulping zone, said method comprising the steps of continuously:

(a) adding steam to material in the first steaming zone while maintaining the pressure at about 10–20 psi;

(b) isolating the first steaming zone from the second steaming zone;

(c) maintaining the pressure in the second steaming zone at about 20–75 psi;

(d) purging the second steaming zone with steam by introducing steam into the material to flow cocurrently with the material into and through the second steaming zone;

(e) venting gases, including vaporized solvent, from the first and second steaming zones;

(f) discharging steamed material from the second steaming zone to the high pressure feeder;

(g) adding solvent to the discharged material from the second steaming zone prior to its introduction into the high pressure feeder; and (h) of purging the second steaming zone with primarily nitrogen gas when the practice of steps (a)–(g) is arrested or terminated, said purging being practiced by introducing said primarily nitrogen gas between the discharge point for steamed material from the second steaming zone and the addition point of solvent into the material flowing to the high pressure feeder.

2. A method as recited in claim 1 wherein the material is moved generally horizontally within the first and second steaming zones.

3. A method as recited in claim 1 wherein step (g) is practiced by adding ethanol as the solvent.

4. A method as recited in claim 3, wherein step (g) is further practiced by adding methanol to the ethanol.

5. A method as recited in claim 4 comprising the further step of recovering ethanol from the gases vented in step (e).

6. A method of steaming cellulosic fibrous material during solvent pulping thereof, utilizing at least one steaming zone, and a high pressure feeder for feeding material mixed with solvent pulping liquor to a pulping zone, said method comprising the steps of continuously:

(a) adding steam to material in the steaming zone while maintaining the pressure at about 10–75 psi;

(b) venting gases, including vaporized solvent, from the steaming zone;

(c) discharging steamed material from the steaming zone to the high pressure feeder;

(d) adding solvent to the discharged material from the second steaming zone prior to its introduction into the high pressure feeder; and (e) purging the steaming zone with primarily nitrogen gas when the practice of steps (a)–(d) is arrested or terminated, said purging being practiced by introducing said primarily nitrogen gas between the discharge point for steamed material from the steaming zone and the addition point of solvent into the material flowing to the high pressure feeder.

7. A method as recited in claim 6 wherein step (d) is practiced by adding ethanol as the solvent.

8. A method as recited in claim 7 wherein step (d) is further practiced by adding a part methanol with the ethanol.

* * * * *